United States Patent [19]

Gallion et al.

[11] Patent Number: 4,525,898

[45] Date of Patent: Jul. 2, 1985

[54] INVERTED TEE CROSS SECTION CLIP

[75] Inventors: James A. Gallion, Cary; Roman M. Tomczak, Raleigh, both of N.C.

[73] Assignee: Tipper Tie, Inc., Apex, N.C.

[21] Appl. No.: 522,111

[22] Filed: Aug. 11, 1983

[51] Int. Cl.[3] ..... B65D 77/18

[52] U.S. Cl. ..... 24/30.5 W; 24/30.5 R; 24/543; 24/563

[58] Field of Search ..... 24/30.5 W, 30.5 R, 543, 24/546, 561, 563, 67.9, 114.5

[56] References Cited

U.S. PATENT DOCUMENTS

| | | | |
|---|---|---|---|
| Re. 30,196 | 1/1980 | Velarde . | |
| 647,693 | 4/1900 | Blantz . | |
| 2,256,107 | 9/1941 | Zadek | 24/561 |
| 2,880,419 | 4/1959 | Tipper . | |
| 3,026,521 | 3/1962 | Panfili . | |
| 3,266,138 | 8/1966 | Tipper . | |
| 3,343,253 | 9/1967 | Omori . | |
| 3,400,433 | 9/1968 | Klenz . | |
| 3,473,430 | 10/1969 | Niedecker . | |
| 3,525,096 | 8/1970 | Klenz . | |
| 3,541,647 | 11/1970 | Marietta, Jr. . | |
| 3,543,378 | 12/1970 | Klenz . | |
| 3,564,663 | 2/1971 | Roberts | 24/30.5 W |
| 3,583,056 | 6/1971 | Klenz . | |
| 3,584,347 | 6/1971 | Klenz . | |
| 3,611,509 | 10/1971 | Klenz . | |
| 3,640,317 | 2/1972 | Panfili . | |
| 3,708,149 | 1/1973 | Dinger | 24/30.5 W |
| 4,131,975 | 1/1979 | Niedecker | 24/30.5 W |
| 4,166,571 | 9/1979 | Niedecker | 24/30.5 W |

FOREIGN PATENT DOCUMENTS

| | | |
|---|---|---|
| 717308 | 1/1932 | France . |

*Primary Examiner*—Victor N. Sakran

*Attorney, Agent, or Firm*—Allegretti, Newitt, Witcoff & McAndrews, Ltd.

[57] ABSTRACT

An improved U-shaped clip of uniform cross section for attachment as a closure includes opposed legs and a connecting crown. The improvement particularly relates to the inverted T-shaped cross sectional shape of the clip.

1 Claim, 5 Drawing Figures

INVERTED TEE CROSS SECTION CLIP

BACKGROUND OF THE INVENTION

This invention relates to an improved clip especially useful as a closure for packaging material.

Numerous patents disclose apparatus for attaching a U-shaped clip about packaging material. Typical of such patents are the following:

| Reg. No. | Inventor | Title | Issue Date |
|---|---|---|---|
| 2,880,419 | Tipper | Apparatus for Fastening Casings with Staple-Like Fasteners | 4/7/59 |
| 3,543,378 | Klenz | Clipping Apparatus | 12/1/70 |
| 3,583,056 | Klenz | Clipping Device | 6/8/71 |
| Re. 30196 | Velarde | Single Piston Operated Clip Device | 1/22/80 |

The clip which is attached about the package of material has over time evolved from a simple U-shaped clip into a clip of various unique structures and configurations. Numerous prior art patents teach such constructions including the following:

| Reg. No. | Inventor | Title | Issue Date |
|---|---|---|---|
| 3,400,433 | Klenz | Clipping Device | 9/10/68 |
| 3,584,347 | Klenz | Clipping Device | 6/15/71 |
| 3,611,509 | Klenz | Method and Apparatus for Forming Clips | 10/12/71 |

Among the patents which teach the construction of various clips are those which show that the cross sectional shape of the wire from which the clip is formed may have a profound effect on the operability and effectiveness of the clip. For example, U.S. Pat. No. 3,400,433 discloses a generally rhombohedral cross section for a clip. Another patent, namely Klenz U.S. Pat. No. 3,584,347, discloses still another cross sectional shape associated with a packaging clip.

With improved and more sophisticated packaging materials, improved clip designs have evolved. It is, for example, desirable to provide clips which require less material in order to save the cost of material as well as the weight of packaging. Also, it is desirable to maintain or improve the mechanical holding ability of the clips which will be used in packaging equipment. Further, it is desirable to provide clips which may be formed by roll forming techniques. In order to have economy of manufacture. Still another desirable feature associated with clips is that they be operable or usable in existing clip attachment machines. With these objectives in mind, the present clip construction was devised.

SUMMARY OF THE INVENTION

Briefly, the present invention relates to an improved U-shaped clip which has a uniform cross sectional shape. The clip serves as a closure and includes opposed legs connected by a crown. The cross sectional shape of the clip is substantially uniform along its entire length and has a generally inverted T-shaped cross section shape in accordance with a special equation. The cross section shape enhances the mechanical properties and utilitarian properties of the clip.

It is thus an object of the invention to provide a clip having a U-shaped cross section which is generally of uniform cross sectional shape along its entire length.

Another object of the invention is to provide a clip which requires less material yet provides equal or improved mechanical properties relative to prior art clips.

Still a further object of the invention is to provide a clip which may be manufactured from wire formed by roll forming or other methods.

Still another object of the invention is to provide a clip which is operable or useful with existing clip attachment equipment.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
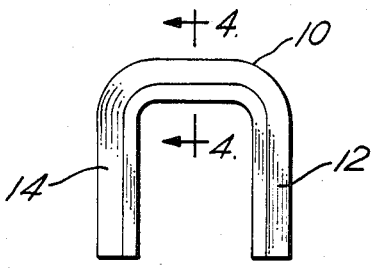
FIG. 1 is a plan view of the improved clip of the present invention.
Figure 2:
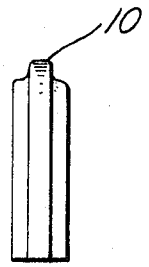
FIG. 2 is a side elevation of the clip of FIG. 1.
Figure 3:
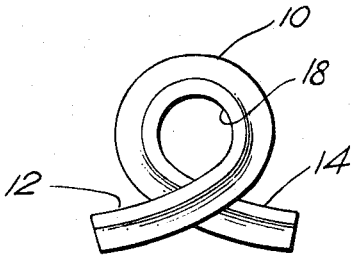
FIG. 3 is a plan view of the clip of FIG. 1 which has been deformed to enclose packaging material.
Figure 4:
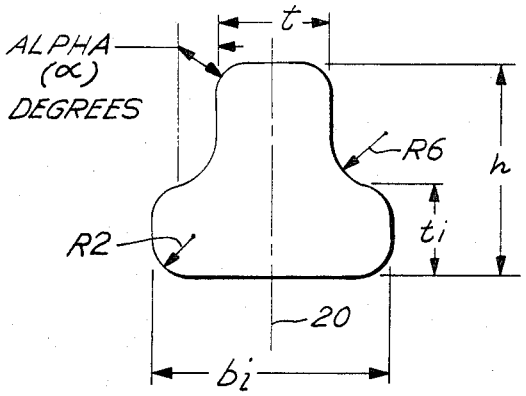
FIG. 4 is an enlarged cross sectional view of the clip of FIG. 1 taken substantially along the line 4—4.

Referring to the figures, the clip of the present invention includes a crown 10 and depending legs 12, 14 which are connected to the crown 10. In manufacture, the wire from which the clip is manufactured is rolled into the cross sectional form or shape such as illustrated by FIG. 4. The wire is then cut to an appropriate length and formed into the U-shaped configuration of FIG. 1 for use as a clip by a clip attachment apparatus. Generally the clip is manufactured from an aluminum alloy or other wire material of desired mechanical properties. The clip, when formed about packaging material, is generally formed to the shape shown in FIG. 3 with the legs 12, 14 being crossed one over the other to define the closure surface 18 and tightened about packaging material.

The subject matter of the present invention relates particularly to the constant cross sectional shape of the clip. Thus, the particular configuration of the U-shaped clip in terms of the length of the legs 12, 14, the extent of the crown 10, and the radial connecting portion between the crown 10 and legs 12, 14 is not a limiting feature of the invention.

FIG. 4 represents graphically a typical cross sectional shape of a clip which is within the scope of the invention. Importantly, the dimensional characteristics of the clip, and more particularly the cross sectional shape of the clip, are defined to enhance the use of material from which the clip is formed. The amount of material is thus reduced to a minimum while the mechanical properties of the clip are maximized. Simultaneously the clip is fashioned in such a manner that it remains usable with existing clip attachment machines without rebuilding of those machines, for example, by replacement of the clip channels.

The configuration of the cross sectional shape in FIG. 4 is represented by the following formulas:

$$Z\,\max = .26*e^{1.7*K} \qquad \text{Equation 1}$$

$$Z\,\min = .02*e^{1.7K} \qquad \text{Equation 2}$$

$$Z = \frac{h*t}{bi*ti} \qquad \text{Equation 3}$$

$$K = \frac{h^2*(40.5*(R6^2 - R2^2) - .06*(R6 - R2) + 1)}{A - (h - ti)^2*\text{TAN(Alpha)}} \qquad \text{Equation 4}$$

where:

A is the cross sectional area measured in square inches;

h is the height of the cross sectional shape of the clip measured in inches;

bi is the width of the head of the cross sectional shape measured in inches;

ti is the height of the head of the cross sectional shape measured in inches;

t is the width of the upright portion of the cross sectional shape measured in inches;

R6 is the radius between the upright portion and head of the cross sectional shape measured in inches;

R2 is the radius measured in inches of the transition of the side of the head with the lower flat of the head as seen in FIG. 4;

Alpha is the angle measured in degrees between a vertical line and the side of the upright portion of the cross section, and cross sectional shape of the clip being generally symmetrical about a plane through the head and leg and generally parallel to the crown and legs; and The value of Z generated in Equation 3 will fall between $Z_{min}$ and $Z_{max}$ generated from Equation 1 and 2 respectively, using the value of K from Equation 4.

Note that the cross sectional shape of the clip is symetrical about a plane defined generally by the plane 20 through the clip. The plane 20 is generally parallel with the crown and legs which form the clip.

Figure 5:
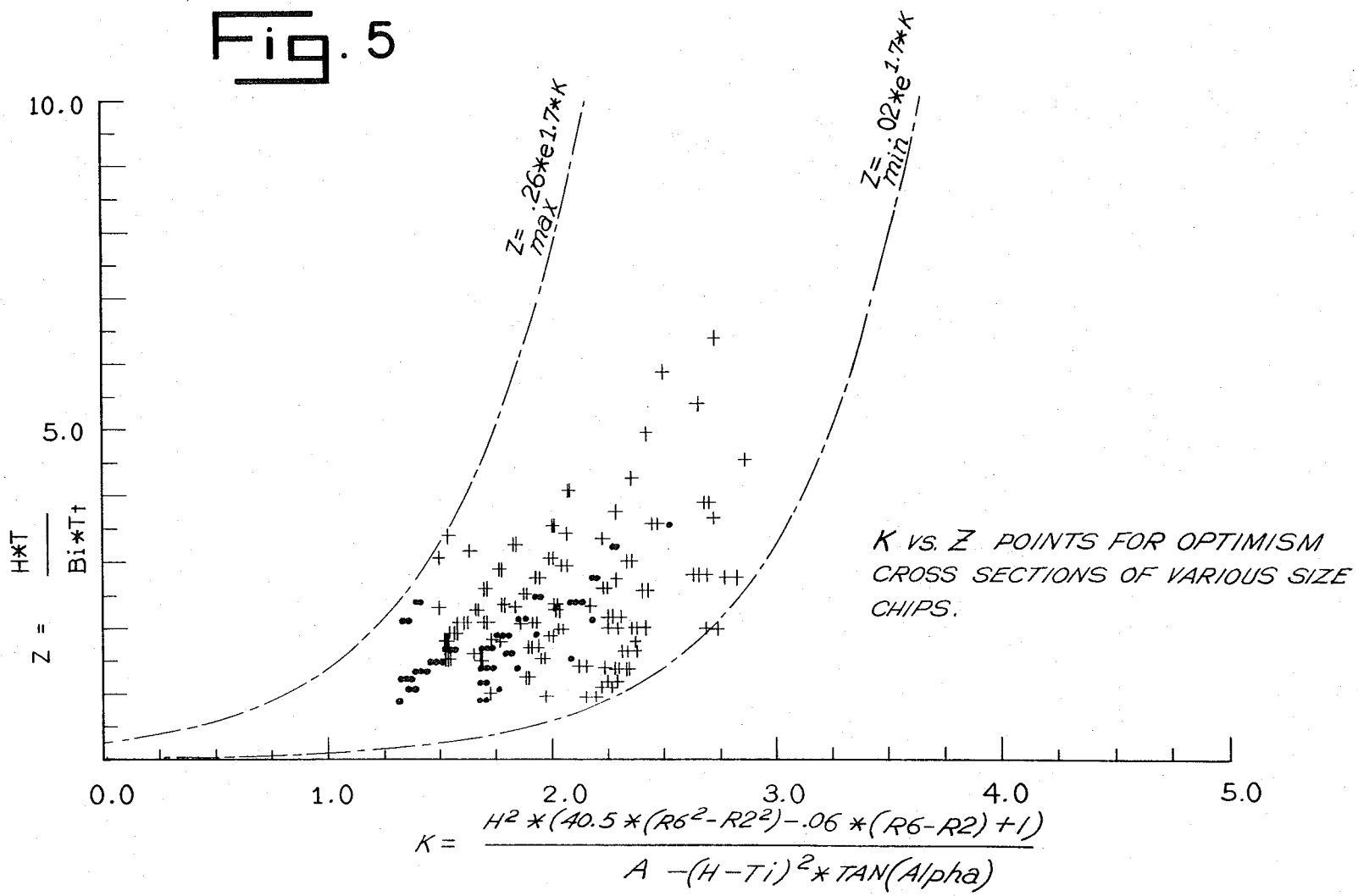
FIG. 5 is a graph which represents the range of dimensional parameters for the cross sectional form of the clip of the invention.

As a result of manufacture of the clip in accordance with the equations set forth, it is possible to graph the family of clips which are within the scope of this formulation and thus constitute, in general, the subject matter of the invention. FIG. 5 is a graph which represents the range of parameters for a clip formed in accordance with the equations set forth.

While there has been set forth a preferred embodiment of the invention, it is to be understood that the invention is to be limited only by the following claims and their equivalents.

What is claimed is:

1. An improved, integral U-shaped clip of uniform cross section for attachment as a closure, said clip including opposed legs connected by a crown, comprising a generally inverted T-shaped cross section including a T-head and a T-leg, said T-head being positioned on the inside of said crown and said opposed legs so as to define a closure surface, said T-leg extending outwardly and away from said closure surface, said T-shaped cross section of said clip being futher defined and limited by the following series of equations relating to a series of design parameters for said clip:

$$Z\,\max = .26*e^{1.7*K} \qquad \text{Equation 1}$$

$$Z\,\min = .02*e^{1.7K} \qquad \text{Equation 2}$$

$$Z = \frac{h*t}{bi*ti} \qquad \text{Equation 3}$$

$$K = \frac{h^2*(40.5*(R6^2 - R2^2) - .06*(R6 - R2) + 1)}{A - (h - ti)^2*\text{TAN(Alpha)}} \qquad \text{Equation 4}$$

wherein said design parameters are defined as follows:

A is the cross sectional area measured in square inches;

H is the height of the cross sectional shape of the clip measured in inches;

bi is the width of the head of the cross sectional shape measured in inches;

ti is the height of the head of the cross sectional shape measured in inches;

t is the width of the upright portion of the cross sectional shape measured in inches;

R6 is the radius between the upright portion and head of the cross sectional shape measured in inches;

R2 is the radius measured in inches of the transition of the side of the head with the lower flat of the head as seen in FIG. 4; and Alpha is the angle measured in degrees between a vertical line and the side of the upright portion of the cross section, said cross sectional shape of the clip being generally symmetrical about a plane through the head and leg and generally parallel to the crown and legs; and the value of Z generated in Equation 3 will fall between Z min and Z max generated from Equation 2 and 3 respectively, using the value of K from Equation 4;

said equations interrelating said design parameters so as to define a limited family of said clip configurations.

* * * * *